United States Patent [19]

Waldvogel

[11] 4,141,521

[45] Feb. 27, 1979

[54] KITE PARACHUTE TOY AND RELEASING DEVICE

[76] Inventor: Donald J. Waldvogel, N81 W14236 Eastwood Dr., Menomonee Falls, Wis. 53051

[21] Appl. No.: 867,526

[22] Filed: Jan. 6, 1978

[51] Int. Cl.[2] ..... B64C 31/06; A63H 27/08

[52] U.S. Cl. ..... 244/155 R

[58] Field of Search ..... 244/155 R

[56] References Cited

U.S. PATENT DOCUMENTS

| | | | |
|---|---|---|---|
| 876,690 | 1/1908 | Carroll | 244/155 R |
| 2,452,746 | 11/1948 | Giara | 244/155 R |
| 3,698,671 | 10/1972 | Barry | 244/155 R |

*Primary Examiner*—Barry L. Kelmachter

[57] ABSTRACT

A novel kite parachute toy, consisting of a plastic parachute toy and a plastic releasing device. The parachute toy having a hook and the releasing device having a forward and rear eyelet for attaching to a kite string. A parachute is attached to the parachute toy and when the hook of the parachute toy is placed over the string of a flying kite, wind will fill the bag of the attached parachute and propel the parachute toy up the string to a releasing device. When the parachute toy meets the releasing device it is released from the kite string and slowly descends to earth with the attached parachute.

3 Claims, 9 Drawing Figures

KITE PARACHUTE TOY AND RELEASING DEVICE

CROSS REFERENCE TO RELATED APPLICATIONS

This invention pertains to that of kite parachutes. Specifically to a parachute toy that can be released at an altitude attainable by the use of a flying kite. To produce such a parachute toy lightweight materials must be used since added weight could adversely effect the flight of a flying kite; operation must be simple and effective so that is can be understood and used by children; and production must be inexpensive in order for it to be marketable at a low retail price in the toy market. Attempts have been made to provide parachute toys, none of which to my knowledge perform unfailingly. Prior art releasing devices require weight to achieve a self-righting position, or they are attached to a kite string in such a manner as to be self-righting, and the releasing performance is limited to that position only.

Kite parachute carriers are also included in the art of kite parachutes. A parachute carrier must slide up the string of a flying kite to be used, and then back down again to be reused, thereby having obvious disadvantages: (1) they are not effective in light wind due to their added weight on the kite string. (2) they limit sending more than one parachute up a kite string at a time.

Known prior art includes U.S. Pat. Nos. 876,690; 2,927,753; 2,930,555; 3,698,671; 3,779,491; and 3,972,496.

SUMMARY OF THE INVENTION

It is the principal object of the present invention to provide a one piece configuration of lightweight plastic to produce a releasing device that will automatically cause a release at all angles of contact, thereby attaining a faultless operation.

Another object of the present invention is to provide a parachute weight of lightweight plastic, so configured as to represent a parachute toy; (toy man, parachutist, image, etc.) with a hook means, and for said hook means to be so designed that upon contact with releasing device, release occurs under any and all conditions.

A final object of the present invention is for simplicity in construction so that manufacture can be by means of injection plastic molding.

The simplicity of this invention, both in construction and in operation, will be apparent upon examination of the following detailed description and accompaning drawings herein:

DETAILED DESCRIPTION

Figure 3:
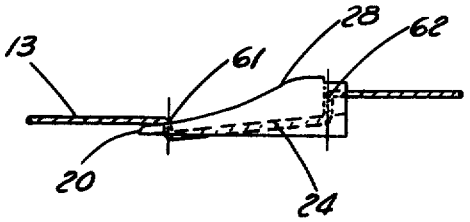
FIG. 3 is a side view of the releasing device.
Figure 4:
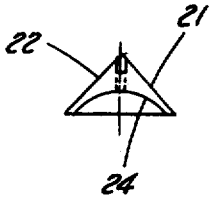
FIG. 4 is a rear view of the releasing device.
Figure 5:
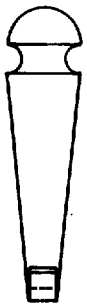
FIG. 5 is a front view of the parachute toy.
Figure 6:
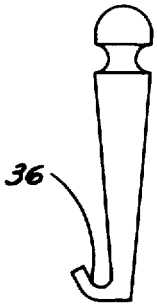
FIG. 6 is a side view of the parachute toy.

Referring now to the drawings, it is shown to include a kite 55 that is secured at one end to a string 13. The releasing device 85 is composed of lightweight plastic and is secured to the string 13 by threading string 13 through eyelet 61, then along concave underside 24 and back up through eyelet 62 as shown in FIG. 3. String 13 coming out of eyelet 62 is then tied to kite 55. Releasing device 85 will slide freely on string 13 to a desired position and will remain at the desired position when string 13 becomes taut as is the case when kite 55 is flying.

Parachute toy 39, having a hook means 36, is also composed of lightweight plastic. A parachute 41 is secured to parachute toy 39 by tying parachute shrouds 16 to parachute toy 39. When using parachute toy 39, the hook means 36 is placed over the kite string 13 so that the parachute 41 can fill with air and propel parachute toy 39 up the kite string 13 to the releasing device 85. Parachute toy 39, upon contact with nose 20 of the releasing device 85, is released from the kite string 13 at all angles of approach because design of the releasing device 85 is such that in any position that releasing device 85 hangs on kite string 13, a release will always occur. (explanation of why release will always occur is detailed hereinafter)

Figure 1:
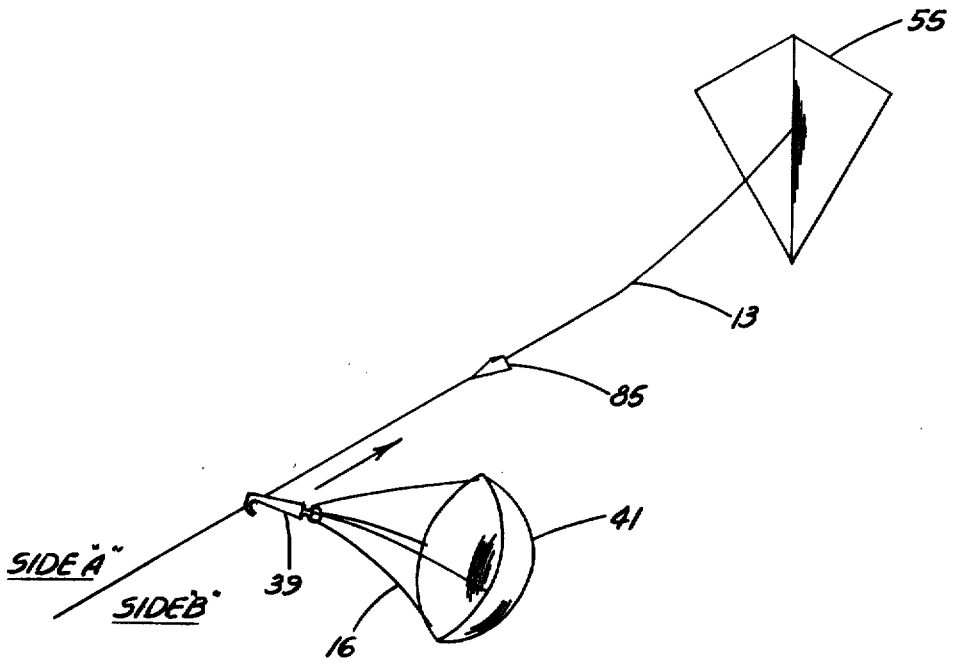
FIG. 1 is a perspective view illustrating the present invention in operation.
Figure 2:
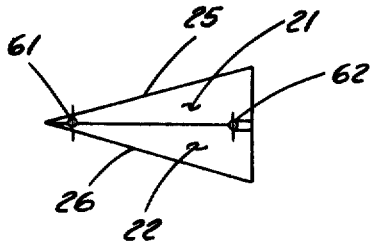
FIG. 2 is a top view of the releasing device.

Parachute toy 39 can be placed on string 13 from side A or side B as shown in FIG 1. The release being detailed is for placement in position B, with corresponding numbers for placement in position A shown in parenthesis ( ).

Figure 7:
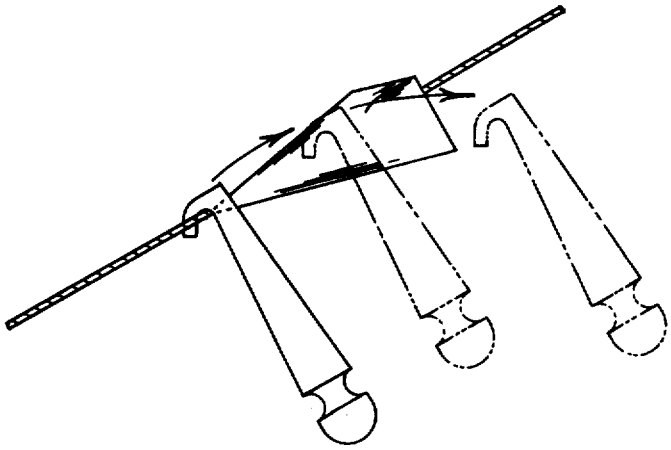
FIG. 7 is a perspective view of the releasing device positioned parallel to earth.

FIG. 7 shows perspective view of the releasing device 85 parallel to earth. Hook means 36 will slide over nose 20 of the releasing device 85 and surface edge 26,(25) will force hook means 36 to slide off surface area 22,(21).

Figure 8:
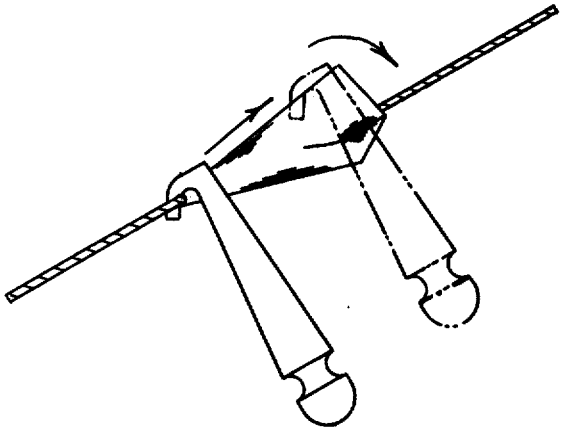
FIG. 8 is a perspective view of the releasing device positioned 90 degrees to earth.

FIG. 8 shows perspective view of the releasing device 85 at a position 90 degrees to earth. Hook means 36 will slide over nose 20 of the releasing device 85 and ride surface edge 25,(26). Parachute toy 39 and raised surface area 28 of releasing device 85 will make contact and at this position an outward pulling action results that overturns releasing device 85 and releases parachute toy 39.

Figure 9:
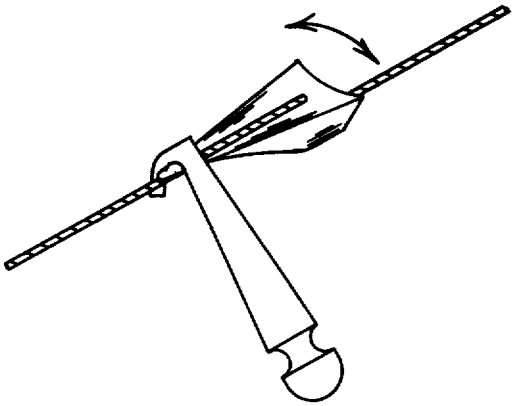
FIG. 9 is perspective view of the releasing device positioned 180 degrees to earth.

FIG. 9 shows perspective view of the releasing device 85 at a position 180 degrees to earth. Hook means 36 will make contact with nose 20 of the releasing device 85 and will ride surface area 24 to a position on surface area 24 where pressure applied by hook means 36 causes releasing device 85 to turn and position itself to release parachute toy 39 from kite string 13 as detailed in FIG. 7 or FIG. 8. (amount of pressure applied to surface area 24 by hook means 36 determines position of release)

I claim:

1. A toy for a kite string including a toy releasing device wherein: said releasing device is triangular in shape, is made of plastic and has a one piece construction and said releasing device comprises forward and rear eyelets for threading to said kite string, a pair of releasing surfaces projecting outwardly and rearwardly from said forward eyelet, a pair of releasing edges formed by the outermost area of said releasing surfaces, a concave underside formed by said releasing surfaces, and a top side that increases in height from said forward eyelet to said rear eyelet.

2. A kite string toy as in claim 1 wherein: said kite string is threaded through the top side of said forward eyelet; said kite string then extending from said forward eyelet along said concave underside to said rear eyelet; and said kite string extending through said rear eyelet whereby said releasing device can freely slide upon said kite string until said kite string becomes taut.

3. A Kite string toy as in claim 1 wherein said toy comprises a plastic kite parachute weight having a one piece construction and hook means mounted on top of said weight.

* * * * *